US007186096B2

(12) United States Patent
Hibino et al.

(10) Patent No.: US 7,186,096 B2
(45) Date of Patent: Mar. 6, 2007

(54) SWASH PLATE TYPE VARIABLE DISPLACEMENT COMPRESSOR

(75) Inventors: Sokichi Hibino, Kariya (JP); Tetsuhiko Fukanuma, Kariya (JP); Hiroaki Kayukawa, Kariya (JP); Eiji Tokunaga, Kariya (JP); Atsuyuki Morishita, Kariya (JP); Tomohiro Murakami, Kariya (JP); Yoshio Kimoto, Kariya (JP); Yoshitami Kondo, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 379 days.

(21) Appl. No.: 10/651,131

(22) Filed: Aug. 28, 2003

(65) Prior Publication Data

US 2005/0031456 A1 Feb. 10, 2005

(30) Foreign Application Priority Data

Aug. 30, 2002 (JP) ..... 2002-255225
Jun. 11, 2003 (JP) ..... 2003-167059

(51) Int. Cl.
*F04B 1/26* (2006.01)

(52) U.S. Cl. ..... 417/422.2; 417/422

(58) Field of Classification Search ..... 417/222.2, 417/228, 222.1; 92/154, 153, 71, 12.2
See application file for complete search history.

(56) References Cited

U.S. PATENT DOCUMENTS 4,005,948 A 2/1977 Hiraga et al. ..... 417/269
4,723,891 A * 2/1988 Takenaka et al. ..... 417/222.2
4,747,753 A * 5/1988 Taguchi ..... 417/222.2
5,816,134 A 10/1998 Takenaka et al. ..... 92/154
6,966,195 B2 * 11/2005 Saeki ..... 62/228.5

FOREIGN PATENT DOCUMENTS

| | | | |
|---|---|---|---|
| CN | 1 163 655 | | 8/2004 |
| EP | 0 789 145 | A1 | 8/1997 |
| EP | 0 794 331 | A2 | 9/1997 |
| EP | 900936 | A2 * | 3/1999 |
| EP | 0 943 802 | A2 | 9/1999 |
| EP | 0 943 802 | A3 | 9/1999 |
| EP | 1 092 873 | A2 | 4/2001 |
| JP | 56-162281 | | 12/1981 |
| JP | 07-035037 | | 2/1995 |
| JP | 2001-020863 | | 1/2001 |
| JP | 2001-107847 | | 4/2001 |
| JP | 2002168173 | A * | 6/2002 |

* cited by examiner

*Primary Examiner*—Ehud Gartenberg
*Assistant Examiner*—Vikansha Dwivedi
(74) *Attorney, Agent, or Firm*—Woodcock Washburn LLP

(57) ABSTRACT

A swash plate type variable displacement compressor includes a cylinder block defining a cylinder bore. A housing is fixed to the cylinder block and defines a crank chamber. A drive shaft is rotatably supported by the housing and the cylinder block. A swash plate is supported by the drive shaft in the crank chamber and is inclinable with respect to the axis of the drive shaft. A piston is accommodated in the cylinder bore so as to define a compression chamber in the cylinder bore and is coupled to the swash plate. A control mechanism includes a bleed passage for controlling the pressure in the crank chamber. The compressor is formed such that lubricating oil in the crank chamber is discharged into at least one of the suction chamber, the discharge chamber and the compression chamber while the inclination angle of the swash plate is substantially a maximum inclination angle.

24 Claims, 12 Drawing Sheets

SWASH PLATE TYPE VARIABLE DISPLACEMENT COMPRESSOR

BACKGROUND OF THE INVENTION

The present invention relates to a swash plate type variable displacement compressor.

A conventional swash plate type variable displacement compressor Includes a cylinder block and a housing. The cylinder block defines a cylinder bore therein. The housing is fixed to the cylinder block and defines a crank chamber, a suction chamber and a discharge chamber. The suction chamber and the discharge chamber are connected to a refrigerating circuit that includes a condenser, an expansion valve and an evaporator. A piston is accommodated in the cylinder bore so as to be able to reciprocate therein. The piston defines a compression chamber in the cylinder bore. A drive shaft is rotatably supported by the cylinder block and the housing. The drive shaft is driven by an external drive source such as an engine of a vehicle. A swash plate is supported by the drive shaft in the crank chamber so as to rotate integrally with the drive shaft and so as to be inclinable with respect to the axis of the drive shaft. The swash plate allows the piston to reciprocate through a pair of shoes and a piston rod. The pressure in the crank chamber is controlled by a control mechanism, There are three types of the control mechanisms. One of the control mechanisms, which is a supply control mechanism, includes a bleed passage that has a constant inner diameter and continuously interconnects the crank chamber with the suction chamber regardless an inclination angle of the swash plate, and adjusts an opening degree of a supply passage which interconnects the discharge chamber with the crank chamber by a control valve. Another control mechanism, which is a bleed control mechanism, adjusts an opening degree of the bleed passage by a control valve. The other control mechanism, which is a three-way valve control mechanism, adjusts both opening degrees of the bleed passage and the supply passage by a control valve.

In the compressor, when the drive shaft is driven by the external drive source, the swash plate rotates integrally with the drive shaft. The piston reciprocates in the cylinder bore in accordance with the inclination angle of the swash plate. Refrigerant gas is introduced from the suction chamber into the compression chamber. The refrigerant gas is discharged to the discharge chamber after compressed. Therefore, refrigeration capacity in the refrigerating circuit is performed in accordance with an amount of the refrigerant gas discharged to the discharge chamber. Since the pressure in the crank chamber is controlled by the control mechanism, the inclination angle of the swash plate is adjusted. As a result, the stroke of the piston is varied, and the amount of the refrigerant gas discharged from the compression chamber to the discharge chamber by the reciprocation of the piston is varied.

In the control mechanism, blow-by gas, which is the refrigerant gas leaked from the compression chamber through a clearance between the cylinder bore and the piston, is supplied to the crank chamber. In the control mechanism including the supply passage, high-pressure refrigerant gas is supplied from the discharge chamber to the crank chamber. On the other hand, in the control mechanism including the bleed passage, the refrigerant gas in the crank chamber is discharged to the suction chamber. The refrigerant gas includes lubricating oil. Therefore, the lubricating oil is stored in the crank chamber, and sliding parts such as the swash plate and the shoes are lubricated by the lubricating oil.

However, in the above-mentioned swash plate type variable displacement compressor, the lubricating oil is excessively stored in the crank chamber in the maximum displacement operation of the compressor, depending on a kind of the control mechanisms. In this case, it is hard to cope with the compression efficiency and the durability of the compressor.

Namely, in the compressor including the supply control mechanism as the control mechanism, the inner diameter of the bleed passage is small so as to be able to increase the pressure in the crank chamber in a displacement-decreasing operation of the compressor, in which the supply passage is opened by the control valve for decreasing the displacement of the compressor. Furthermore, in the maximum displacement operation of the compressor, in which the pressure in the crank chamber is relatively low, the supply passage is closed by the control valve. So the high-pressure refrigerant gas in the discharge chamber is not supplied to the crank chamber. Therefore, in the maximum displacement operation of the compressor, the lubricating oil stored in the crank chamber is not pushed out to the bleed passage by the refrigerant gas. As a result, the lubricating oil is excessively stored in the crank chamber.

Also, in the compressor including the three-way valve control mechanism as the control mechanism, when the displacement of the compressor is decreased by increasing the pressure in the crank chamber, the supply passage is opened by the control valve and the bleed passage is closed by the control valve. On the other hand, when the displacement of the compressor is increased by decreasing the pressure in the crank chamber, the supply passage is closed by the control valve and the bleed passage is opened by the control valve. Therefore, the opening degree of the bleed passage, which becomes the maximum by the control valve in the maximum displacement operation of the compressor, is not relatively large. Furthermore, in the maximum displacement operation of the compressor, the supply passage is closed, and the high-pressure refrigerant gas in the discharge chamber is not supplied to the crank chamber. Therefore, in the maximum displacement operation of the compressor, the lubricating oil stored in the crank chamber is hard to push out to the bleed passage by the refrigerant gas. The lubricating oil is easily excessively stored in the crank chamber. Although the three-way valve control mechanism includes the bleed passage, the lubricating oil is easily excessively stored in the crank chamber due to a small inner diameter of the bleed passage.

On the other hand, in the compressor including the bleed control mechanism as the control mechanism, the pressure in the crank chamber is increased by the blow-by gas that is continuously supplied to the crank chamber and by the high-pressure refrigerant gas that is continuously supplied to the crank chamber through the supply passage. Therefore, in the maximum displacement operation of the compressor, the opening degree of the bleed passage is large. As a result, the lubricating oil is hard to store in the crank chamber excessively.

When the control mechanism is the supply control mechanism or the three-way valve control mechanism, in the maximum displacement operation of the compressor, the lubricating oil is excessively stored in the crank chamber. Therefore, the ratio of the lubricating oil in the refrigerant gas is decreased in the refrigerating circuit, and the refrigerant gas that does not contain much lubricating oil is introduced from the suction chamber into the compression chamber. As a result, sliding performance of the piston in the cylinder bore may deteriorate, and it is worried that the durability of the piston deteriorates.

In order to solve the above problem, it is considered to increase the ratio of the lubricating oil in the refrigerant gas. However, in the compressor, in the displacement-decreasing operation of the compressor, in which the pressure in the crank chamber is relatively high, the supply passage is opened by the control valve. The high-pressure refrigerant gas is supplied to the crank chamber, and the lubricating oil stored in the crank chamber is easily pushed out to the bleed passage by the high-pressure refrigerant gas. Therefore, if the ratio of the lubricating oil in the refrigerant gas is increased, a large amount of the lubricating oil, which is pushed out in the displacement-decreasing operation of the compressor, is mixed in the refrigerant gas in the refrigerating circuit. The ratio of the lubricating oil in the refrigerant gas in the refrigerating circuit becomes excessively high. As a result, the compression efficiency of the compressor becomes low.

A communication path that interconnects the crank chamber with the compression chamber is disclosed in Japanese Unexamined Patent Publication No. 56-162281, No. 7-35037, No. 2001-107847 and No.2001-20863, and International Publication No. WO96/39581.

In the compressor disclosed in Japanese Unexamined Patent Publication No. 56-162281, a swash plate is fixed to a drive shaft and is not inclinable with respect to the axis of the drive shaft. The compressor does not include a control mechanism that controls the pressure in the crank chamber for changing the displacement of the compressor. In the compressor, which is a fixed displacement type, only volumetric efficiency is improved by interconnecting the crank chamber or a swash plate chamber with the compression chamber by the communication path.

In the compressor disclosed in Japanese Unexamined Patent Publication No. 7-35037, refrigerant gas in the crank chamber is introduced into the compression chamber through the communication path that interconnects the crank chamber with the compression chamber. Lubricating oil in the crank chamber is not discharged into the compression chamber in the maximum displacement operation of the compressor. The communication path only allows the refrigerant gas to move from a suction chamber to the crank chamber, and the pressure in the crank chamber is not decreased through the communication path.

In the compressor disclosed in Japanese Unexamined Patent Publication No. 2001-107847, the communication path that interconnects the crank chamber with the compression chamber functions as a passage for blow-by gas. Lubricating oil in the crank chamber is not discharged into the compression chamber in the maximum displacement operation of the compressor.

A compressor in which a groove is formed on the outer circumferential surface of the piston is disclosed in Japanese Unexamined Patent Publication No. 2001-20863 and International Publication No. WO96/39581. However, in the compressor disclosed in Japanese Unexamined Patent Publication No. 2001-20863, the groove does not interconnect the crank chamber with the compression chamber and only functions as a fluid bearing. Also, in the compressor disclosed in International Publication No. WO96/39581, the groove does not interconnect the crank chamber with the compression chamber and is only for storing the lubricating oil in a cylinder bore therein.

SUMMARY OF THE INVENTION

The present invention is directed to a swash plate type variable displacement compressor including a control mechanism that decreases pressure in a crank chamber by a bleed passage interconnecting the crank chamber with a suction chamber, wherein the durability and compression efficiency of the swash plate type variable displacement compressor are compatible with each other without excessively storing lubricating oil in the crank chamber in the maximum displacement operation of the compressor.

In accordance with the present invention, a swash plate type variable displacement compressor connected to an external drive source for compressing refrigerant gas that contains lubricating oil includes a cylinder block, a housing, a drive shaft, a swash plate, and a piston. The cylinder block defines a cylinder bore. The housing is fixed to the cylinder block and defines a crank chamber, a suction chamber and a discharge chamber. The drive shaft is supported by the housing and the cylinder block for rotation and is driven by the external drive source. The drive shaft has an axis. The swash plate is supported by the drive shaft in the crank chamber so as to rotate integrally with the drive shaft The swash plate is inclinable with respect to the axis of the drive shaft. An inclination angle of the swash plate is varied in accordance with the pressure in the crank chamber. The piston is accommodated in the cylinder bore so as to define a compression chamber in the cylinder bore and is coupled to the swash plate. The rotation of the swash plate is converted into the reciprocating movement of the piston, and the displacement of the compressor is varied by the reciprocation of the piston in accordance with the inclination angle of the swash plate. The compressor also includes a control mechanism for controlling pressure in the crank chamber. The control mechanism includes a bleed passage that interconnects the crank chamber with the suction chamber for decreasing the pressure in the crank chamber. The compressor is formed such that the lubricating oil stored in the crank chamber is discharged into at least one of the suction chamber, the discharge chamber and the compression chamber while the inclination angle of the swash plate is substantially a maximum inclination angle.

BRIEF DESCRIPTION OF THE DRAWINGS

The features of the present invention that are believed to be novel are set forth with particularity in the appended claims. Aspect of the invention may best be understood by reference to the following description of the presently preferred embodiments together with the accompanying drawings in which:

DETAILED DESCRIPTION OF THE PREFERRED EMBODIMENTS

Preferred embodiments 1 through 12 according to the present invention will be described by referring to FIGS. 1 through 21 hereafter.

Figure 1:
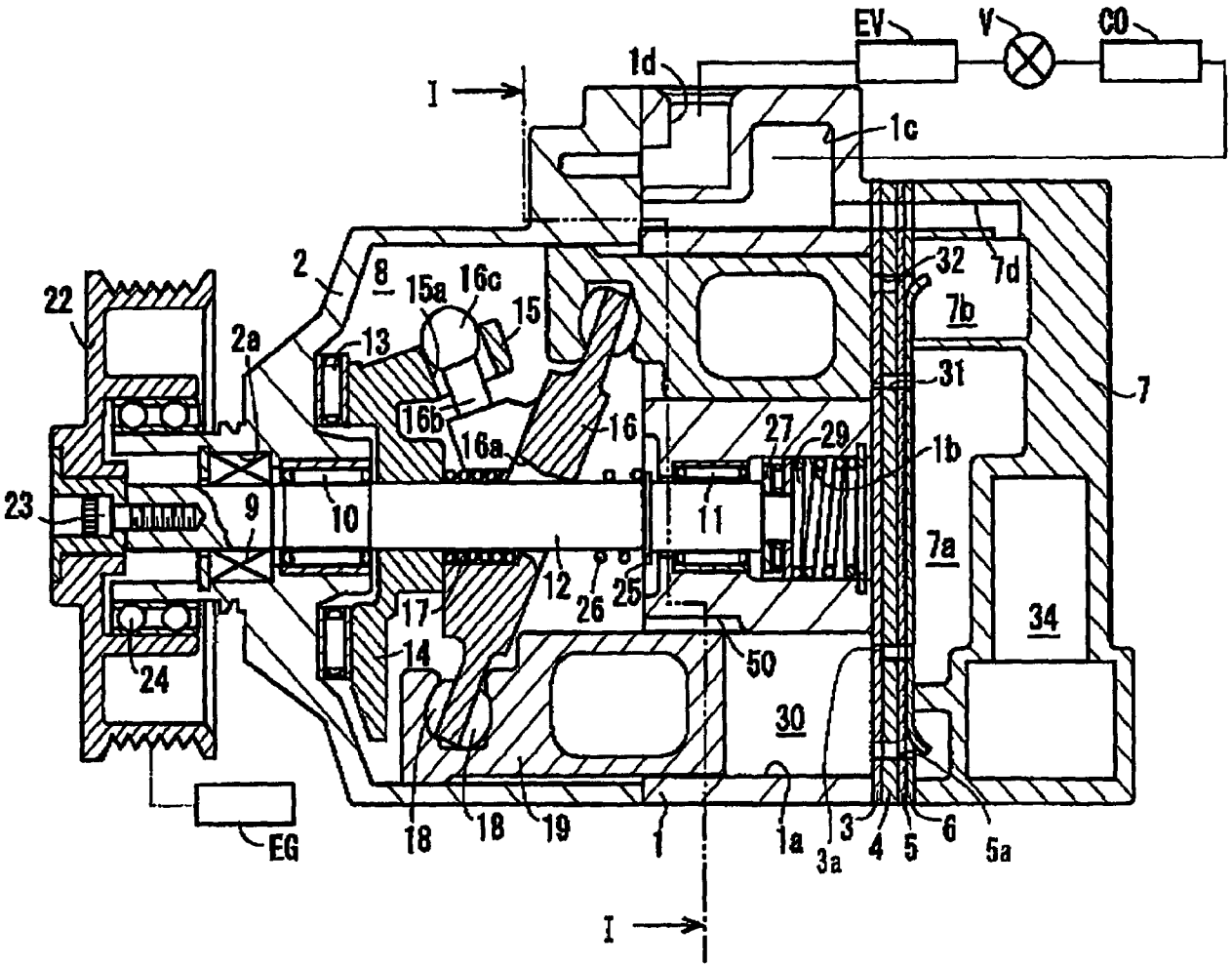
FIG. 1 is a longitudinal cross-sectional view of a compressor according to a first preferred embodiment.

Now, the first preferred embodiment will be described. As shown in FIG. 1, a compressor of the first preferred embodiment has a cylinder block 1 and a housing that includes a cup-shaped front housing 2 and a rear housing 7. In FIG. 1, the left side and the right side of the drawing respectively correspond to the front side and the rear side of the compressor. The cylinder block 1 has seven bore surfaces that define seven cylinder bores 1*a*, a shaft hole 1*b*, a muffler chamber 1*c* and an inlet 1*d*. The front housing 2 is fixed to the front end of the cylinder block 1. The rear housing 7 is fixed to the rear end of the cylinder block 1. A suction valve plate 3, a valve plate 4, a discharge valve plate 5 and a retainer plate 6 are placed between the rear housing 7 and the cylinder block 1.

A shaft hole 2*a* is formed in the front housing 2. A crank chamber 8 is defined by the front end of the cylinder block 1 and the front housing 2. A shaft seal 9 and a radial bearing 10 are arranged in the shaft hole 2*a*. A radial bearing 11 is arranged in the shaft hole 1*b*. A drive shaft 12 is rotatably supported by the front housing 2 through the shaft seal 9 and the radial bearing 10, and by the cylinder block 1 through the radial bearing 11 in the crank chamber 8.

A lug plate 14 is secured to the drive shaft 12 in the crank chamber 8. A thrust bearing 13 is interposed between the front housing 2 and the lug plate 14. A pair of support arms 15 is mounted on the lug plate 14 so as to protrude rearward. A guide hole 15*a* is formed in each support arm 15 and has a cylindrical inner surface. The drive shaft 12 is interposed through a through hole 16*a* of a swash plate 16. A spring 17 for decreasing inclination angle is arranged between the swash plate 16 and the lug plate 14. A circlip 25 is fitted around the drive shaft 12 near the shaft hole 1*b* of the cylinder block 1. A restoring spring 26 is arranged between the circlip 25 and the swash plate 16. A thrust bearing 27 is arranged at the rear end of the drive shaft 12 in the shaft hole 1*b* of the cylinder block 1. A spring 29 is arranged between the thrust bearing 27 and the suction valve plate 3.

A pair of guide pins 16*b* is mounted on the front side of the swash plate 16 so as to protrude toward each support arm 15. A guide ball 16*c* having a spherical surface is formed on a top of each of the guide pins 16*b* so as to slidably move in the guide hole 15*a*. Therefore, the swash plate 16 is supported by the drive shaft 12 so as to rotate integrally with the drive shaft 12 and so as to be inclinable with respect to the axis of the drive shaft 12. A hollow piston 19 is accommodated in each of the cylinder bores 1*a*. The piston 19 is coupled to the swash plate 16 through a pair of shoes 18. The outer circumferential surface of each of the pistons 19 is covered with a sliding film that solid lubricant such as PTFE (polytetrafluoroethylene) is dispersed in binder resin made of polyamide-imide. The compressor is designed such that the position of the top dead center of the piston 19 in the maximum displacement operation of the compressor is substantially identical to that in the minimum displacement operation of the compressor. A compression chamber 30 is defined by the cylinder bore 1*a* and the piston 19. An inclination angle of the swash plate 16 is an angle between the swash plate 16 and a hypothetical plane perpendicular to the axis of the drive shaft 12. A maximum inclination angle of the swash plate 16 is an angle between the swash plate 16 and the hypothetical plane perpendicular to the axis of the drive shaft 12 when the swash plate 16 contacts the lug plate 14.

The drive shaft 12 protrudes frontward from the front housing 2, and a pulley 22 is fixed to the front end of the drive shaft 12 by a bolt 23. The pulley 22 is supported by the front housing 2 through a ball bearing 24. The pulley 22 is coupled to a belt, and the belt is connected to an engine EG as an external drive source.

A suction chamber 7*a* is defined in the rear housing 7 and is interconnected with the inlet 1*d* through a suction passage, which is not shown. A suction port 31 is formed in the retainer plate 6, the discharge valve plate 5 and the valve plate 4. A suction valve 3*a* is formed in the suction valve plate 3. The suction chamber 7*a* is interconnected with each of the cylinder bores 1*a* through the suction port 31 and the suction valve 3*a*. The inlet 1*d* is connected to an evaporator EV in a refrigerating circuit by a pipe. The evaporator EV is connected to a condenser CO by a pipe via an expansion valve V. A discharge chamber 7*b* is defined around the suction chamber 7*a* in the rear housing 7. A discharge passage 7*d* is formed in the rear housing 7 by extending through the retainer plate 6, the discharge valve plate 5, the valve plate 4 and the suction valve plate 3. The discharge passage 7*d* interconnects the discharge chamber 7*b* with the muffler chamber 1*c*. The muffler chamber 1*c* is connected to the condenser in the refrigerating circuit by a pipe. A discharge port 32 is formed in the valve plate 4 and the suction valve plate 3. A discharge valve 5*a* is formed in the discharge valve plate 5. The discharge chamber 7*b* is interconnected with each of the cylinder bores 1*a* through the discharge port 32 and the discharge valve 5*a*.

Figure 2A:
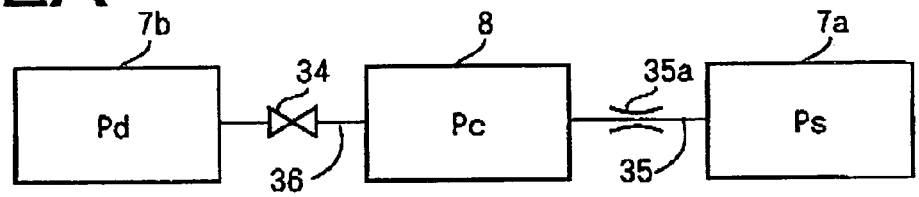
FIG. 2A is a view illustrating a supply control mechanism according to the first preferred embodiment.

A control valve 34 is arranged in the rear housing 7. As shown in FIG. 2A, a supply passage 36 interconnects the discharge chamber 7*b* with the crank chamber 8, and the control valve 34 is arranged on the supply passage 36. The opening degree of the control valve 34 can be adjusted in accordance with a suction pressure Ps in the suction chamber 7*a*. A bleed passage 35 interconnects the crank chamber 8 with the suction chamber 7*a* for decreasing the pressure in the crank chamber 8. The bleed passage 35 has a throttle 35*a* with a constant inner diameter and continuously interconnects the crank chamber 8 with the suction chamber 7*a* regardless the inclination angle of the swash plate 16. A clearance is formed in the piston 19 shown in FIG. 1 between the piston 19 and the cylinder bore 1*a*. Blow-by gas, which is the refrigerant gas leaked from the compression chamber 30 to the crank chamber 8, is supplied to the crank chamber 8 through the clearance. In the compressor, a supply control mechanism which is a control mechanism for controlling the pressure in the crank chamber 8 is constituted of the supply passage 36, the control valve 34, the bleed passage 35, and the clearance between the piston 19 and the cylinder bore 1*a*.

Figure 3:
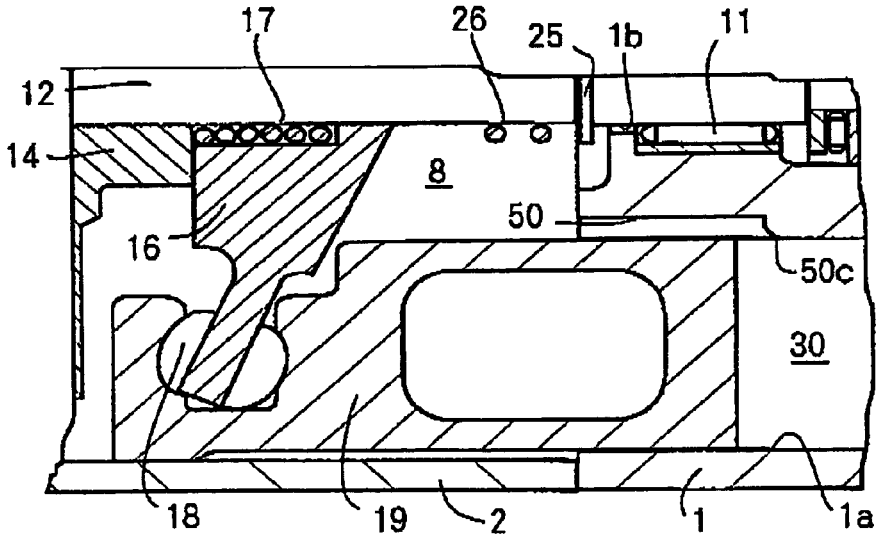
FIG. 3 is a partially enlarged longitudinal cross-sectional view of the compressor according to the first preferred embodiment.
Figure 4:
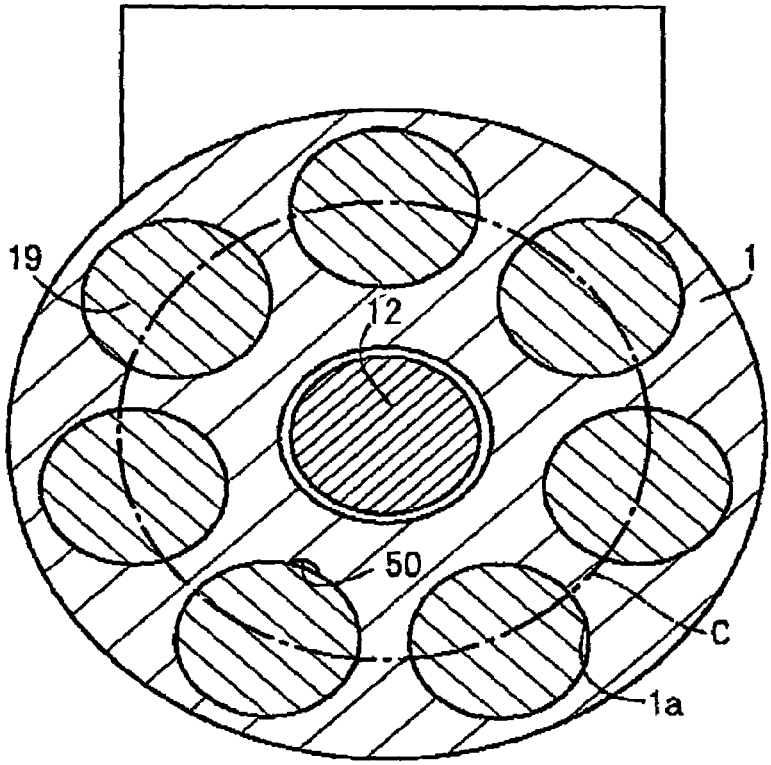
FIG. 4 is a view taken by the line I—I in FIG. 1 of the first preferred embodiment.
Figure 5:
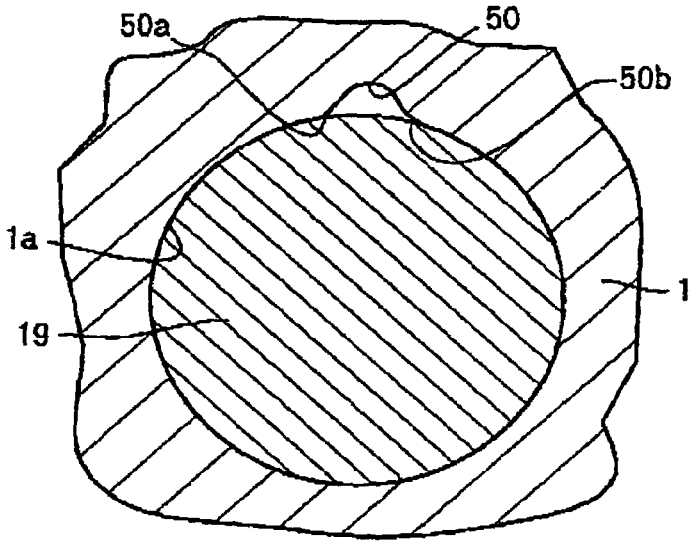
FIG. 5 is a partially enlarged view of FIG. 4.

As a characteristic structure of the compressor, as shown in FIGS. 3 and 4, a communication groove 50 as a communication path is formed in the surface of one of the cylinder bores 1*a* and interconnects the crank chamber 8 with the associated compression chamber 30. The communication groove 50 axially extends from a crank chamber side toward a suction valve plate side in the bore surface of the cylinder block 1, The communication groove 50 has a length so as to cross the rear end of the piston 19 while the inclination angle of the swash plate 16 is substantially the maximum inclination angle and the piston 19 is located substantially at its bottom dead center. Namely, the communication groove 50 interconnects the crank chamber 8 with the compression chamber 30 while the inclination angle of the swash plate 16 is substantially the maximum inclination angle and the piston 19 is located substantially at its bottom dead center. Therefore, when the piston 19 is in a compression process, the refrigerant gas in the compression chamber 30 does not leak to the crank chamber 8 through the communication groove 50. Furthermore, as shown in FIG. 4, the communication groove 50 is located in an inner circumferential area that is near the drive shaft 12, that is, inside a circle C that passes through the center axis of each of the cylinder bore 1*a*. As shown in FIG. 5, arcuate chamfers 50*a* and 50*b* are formed respectively at both side surfaces of the communication groove 50. As shown in FIGS. 1 and 3, an arcuate chamfer 50*c* is formed at the periphery of the communication groove 50 at a compression chamber side. The communication groove 50 is relatively easily formed only by working the cylinder block 1.

In the above-constructed compressor, as shown in FIG. 1, while the engine EG is running, the pulley 22 is rotated by the engine EG via the belt, and the drive shaft 12 is continuously driven. The swash plate 16 oscillates as the swash plate 16 is rotated by the drive shaft 12, and the piston 19 reciprocates in the cylinder bore 1*a*. Namely, the rotation of the swash plate 16 is converted into the reciprocating movement of the piston 19. Therefore, the refrigerant gas in the evaporator in the refrigerating circuit is introduced into the suction chamber 7*a* through the inlet 1*d*. After compressed in the compression chamber 30, the refrigerant gas is discharged into the discharge chamber 7*b*. The refrigerant gas in the discharge chamber 7*b* is discharged to the condenser CO through the muffler chamber 1*c*.

During the above period, the blow-by gas is supplied from the compression chamber 30 to the crank chamber 8 through the clearance between the cylinder bore 1*a* and the piston 19. As shown in FIG. 2A, the control valve 34 adjusts the opening degree of the supply passage 36 in accordance with the suction pressure Ps in the suction chamber 7*a*. Therefore, when the supply passage 36 is opened by the control valve 34, the refrigerant gas having the discharge pressure Pd in the discharge chamber 7*b* is supplied to the crank chamber 8 through the supply passage 36. On the other hand, the refrigerant gas in the crank chamber 8 is discharged to the suction chamber 7*a* through the bleed passage 35. Therefore, the pressure Pc in the crank chamber 8 is varied, and the back pressure that is applied to the piston 19 shown in FIG. 1 is varied. Then, the inclination angle of the swash plate 16 is varied, and the stroke of the piston 19 is varied. As a result, the displacement of the compressor can be practically changed from 0% to 100%. Namely, the displacement of the compressor is varied by the reciprocation of the piston 19 in accordance with the inclination angle of the swash plate 16. The refrigerant gas contains lubricating oil. Therefore, the lubricating oil is stored in the crank chamber 8, and sliding parts such as the swash plate 16 and the shoes 18 are lubricated by the lubricating oil.

In the compressor, the inner diameter of the throttle 35*a* of the bleed passage 35 is small such that the pressure Pc in the crank chamber 8 is capable of being increased in a displacement-decreasing operation of the compressor in which the supply passage 36 is opened by the control valve 34 for decreasing the displacement of the compressor. In the maximum displacement operation of the compressor, in which the pressure Pc in the crank chamber 8 is relatively low, the supply passage 36 is closed by the control valve 34. So the refrigerant gas having the discharge pressure Pd in the discharge chamber 7*b* is not supplied to the crank chamber 8. Therefore, in the maximum displacement operation of the compressor, the lubricating oil is not pushed out into the bleed passage 35 by the high-pressure refrigerant gas supplied from the discharge chamber 7*b*. As a result, the lubricating oil tends to be excessively stored in the crank chamber 8.

In the maximum displacement operation of the compressor, which is a state that the inclination angle of the swash plate 16 is substantially the maximum inclination angle, only while the piston 19 is located substantially at its bottom dead center, the crank chamber 8 is interconnected with the compression chamber 30 through the communication groove 50 as shown in FIG. 3. Therefore, the lubricating oil stored in the crank chamber 8 is discharged into the compression chamber 30 in the maximum displacement operation of the compressor. The compressor is designed such that the position of the top dead center of the piston 19 in the maximum displacement operation of the compressor is substantially identical to that in the minimum displacement operation of the compressor. Therefore, the lubricating oil in the crank chamber 8 can be discharged into the compression chamber 30 only in the maximum displacement operation of the compressor. Also, an appropriate amount of the lubricating oil can be stored in the crank chamber 8 when the compressor is not in the maximum displacement operation. In this way, the lubricating oil in the crank chamber 8 is easily discharged into the compression chamber 30 through the communication groove 50 in the maximum displacement operation of the compressor.

According to the first preferred embodiment, following advantageous effects are obtained.

The crank chamber 8 is interconnected with the compression chamber 30 through the communication groove 50 only while the inclination angle of the swash plate 16 is substantially the maximum inclination angle and the piston 19 is located substantially at its bottom dead center. Therefore, in the compressor, the lubricating oil in the crank chamber 8 can be discharged into the compression chamber 30 only in the maximum displacement operation of the compressor. The lubricating oil discharged to the compression chamber 30 enhances sliding performance between the cylinder bore 1*a* and the piston 19. If the lubricating oil stored in the crank chamber 8 is discharged to the compression chamber 30 even while the inclination angle of the swash plate 16 is not substantially the maximum inclination angle, the appropriate amount of the lubricating oil is hard to store in the crank chamber 8. In this case, the lubricity of the sliding parts of the swash plate 16 and the shoes 18 easily deteriorates. However, in this embodiment, the appropriate amount of the lubricating oil can be stored in the crank chamber 8 even though the compressor is not in the maximum displacement operation. Therefore, the lubricity of the sliding parts of the swash plate 16 and the shoes 18 15 can be ensured.

Also, since the arcuate chamfers 50*a* through 50*c* are respectively formed at both side surfaces of the communication groove 50 and at the periphery of the communication groove 50 at the compression chamber side in the compressor, abrasion of the piston 19 is avoided even when the piston 19 that reciprocates in the cylinder bore 1*a* slightly rolls in a circumferential direction of the cylinder bore 1*a*. Durability of the piston 19 is maintained, and the sliding performance of the piston 19 is excellent. Furthermore, the lubricant oil in the communication groove 50 is easily discharged into the compression chamber 30 due to the chamfers 50*a* through 50*c*.

The lubricating oil in the crank chamber 8 tends to exist in the lower side in the crank chamber 8 due to its own weight. The lubricating oil in the crank chamber 8 also tends to exist in an outer circumferential area that is far from the drive shaft 12 due to centrifugal force generated by the rotation of the swash plate 16. The outer circumferential area is outside the circle C that passes through the center axis of each of the cylinder bores 1*a*. Therefore, since the communication groove 50 is located near the drive shaft 12 in the inner circumferential area as shown in FIG. 4, the lubricating oil in the crank chamber 8 can be gradually reduced. Also, side force is applied to the piston 19 in the compressor due to compression and suction reactive force such that the piston 19 is inclined with respect to the axis of the drive shaft 12 to have more distance from the rear side to the front side, while the compressor is driven. Therefore, the front side end of the piston 19 at a swash plate side is easy to press against the cylinder bore 1*a* at the outer side of the bore surface of the cylinder block 1. However, since the communication groove 50 is formed at the inner side of the bore surface of the cylinder block 1. Therefore, the abrasion of the piston 19, especially abrasion of the sliding film can be more certainly avoided.

Thus, in the compressor, the ratio of the lubricating oil in the refrigerant gas in the refrigerating circuit is hard to excessively decrease, and the refrigerant gas appropriately containing the lubricating oil is introduced from the suction chamber 7*a* to the compression chamber 30 through the inlet 1*d*. Therefore, the sliding performance between the piston 19 and the cylinder bore 1*a* does not deteriorate, and the durability of the piston 19 is excellent. Furthermore, since it is unnecessary to excessively increase the ratio of the lubricating oil in the refrigerant gas, compression efficiency of the compressor can be maintained.

Consequently, the lubricating oil is not excessively stored in the crank chamber 8, and the excellent durability of the compressor can be compatible with maintaining the compression efficiency of the compressor.

The compressor is a clutchless compressor whose drive shaft 12 is continuously driven while the engine EG is running. In a conventional clutchless compressor, the lubricating oil is excessively stored in the crank chamber in the maximum displacement operation of the compressor. If the relatively large amount of the lubricating oil is still stored in the crank chamber in the minimum displacement operation of the compressor, the swash plate stirs the lubricating oil in the crank chamber, and the lubricating oil becomes hot by shearing. In this case, the temperature of the compressor becomes extremely high. As a result, seal members deteriorate, and the durability of the compressor deteriorates. On the other hand, the lubricating oil is not excessively stored in the crank chamber 8 in the compressor of the first preferred embodiment. Therefore, seal members such as the shaft seal 9 and an O-ring, which is not shown, are hard to deteriorate, and the durability of the seal members is excellent.

A second, third, fourth, fifth, sixth, seventh, eighth, ninth, tenth, eleventh and twelfth preferred embodiments will be described by referring to FIGS. 6 through 21. The same reference numerals denote the substantially identical elements as those in the first preferred embodiment.

Figure 6:
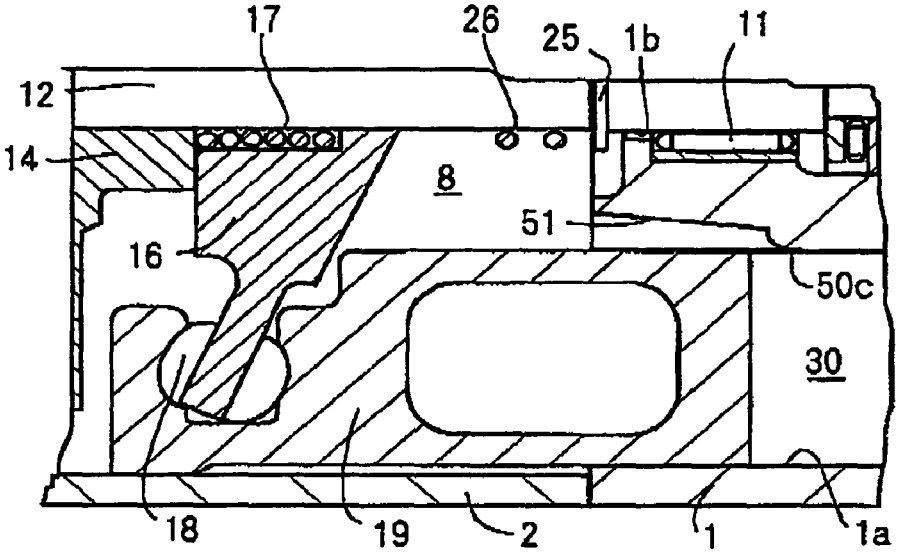
FIG. 6 is a partially enlarged longitudinal cross-sectional view of a compressor according to a second preferred embodiment.

In a compressor of the second preferred embodiment, as shown in FIG. 6, the communication groove 50 of the first preferred embodiment is changed to a communication groove 51 as a communication path. The communication groove 51 formed in the bore surface of the cylinder block 1 is deeper at the crank chamber side than at the compression chamber side so as to have a trapezoidal longitudinal section. Therefore, the cross-sectional area of the communication groove 51 at the crank chamber side is larger than that at the compression chamber side. Namely, the cross-sectional area of the end of the communication groove 51 at the crank chamber side is larger than any other cross-sectional area of the communication groove 51. The other structure of the compressor is the same as the compressor in the first preferred embodiment.

In the compressor, the lubricating oil in the crank chamber 8 is easily introduced into the communication groove 51 in the maximum displacement operation of the compressor. Therefore, the advantageous effects of the present invention can be enhanced.

Figure 7:
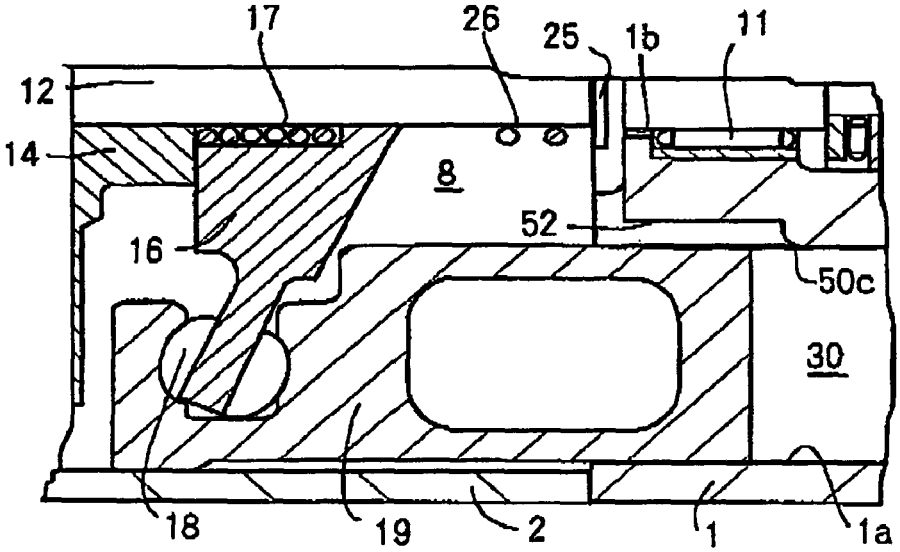
FIG. 7 is a partially enlarged longitudinal cross-sectional view of a compressor according to a third preferred embodiment.

In a compressor of the third preferred embodiment, as shown in FIG. 7, the communication groove 50 of the first preferred embodiment is changed to a communication groove 52 as the communication path. The communication groove 52 at the crank chamber side extends toward the drive shaft 12. Therefore, the cross-sectional area of the communication groove 52 at the crank chamber side is larger than that at the compression chamber side. The other structure of the compressor is the same as the compressor in the first preferred embodiment. In the compressor, the same advantageous effects are obtained as mentioned in the second preferred embodiment.

Figure 8:
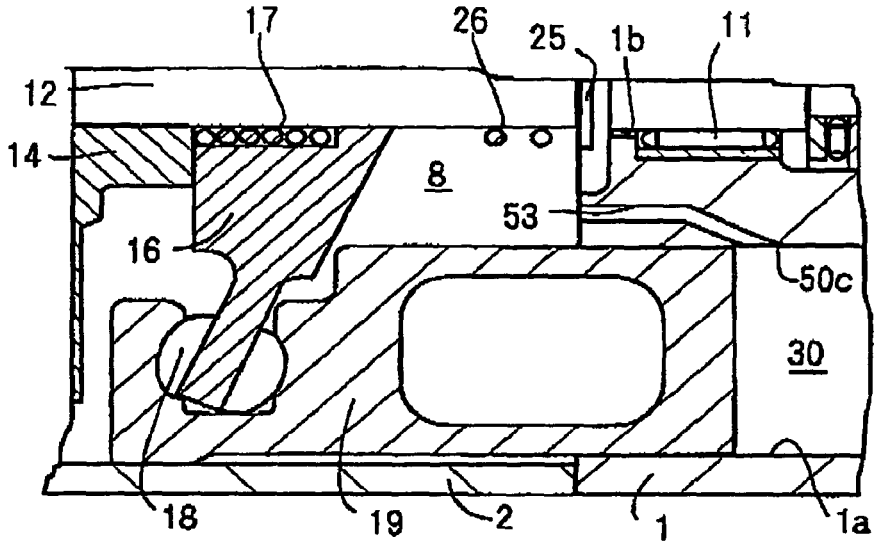
FIG. 8 is a partially enlarged longitudinal cross-sectional view of a compressor according to a fourth preferred embodiment.
Figure 9:
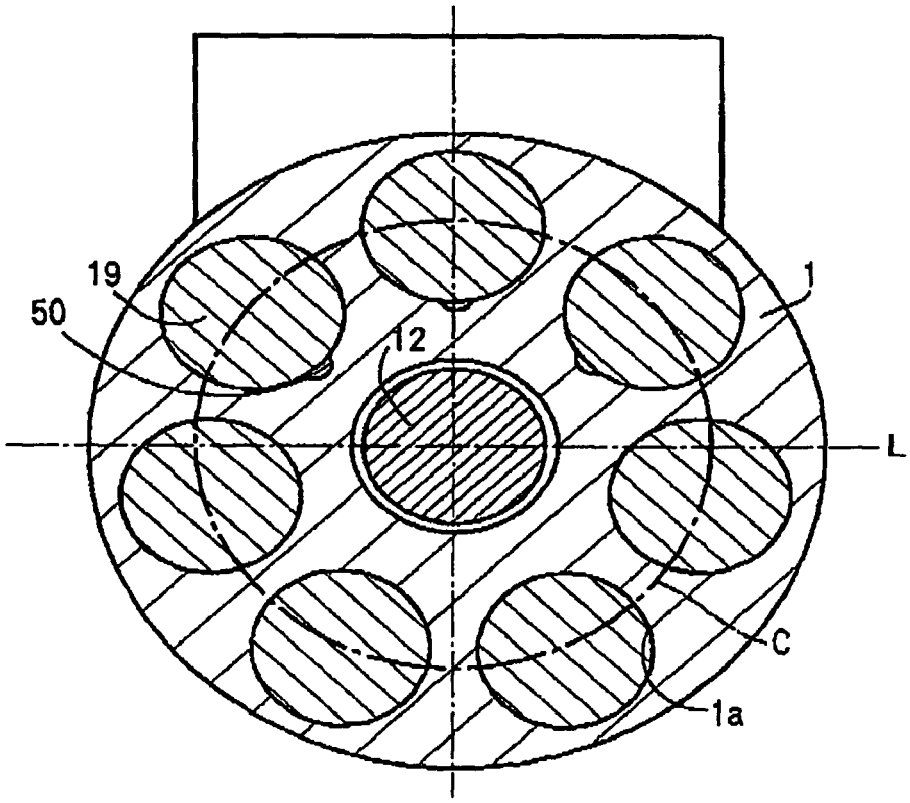
FIG. 9 is a cross-sectional view of a compressor according to a fifth preferred embodiment.

In a compressor of the fourth preferred embodiment, as shown in FIG. 8, the communication groove 50 of the first preferred embodiment is changed to a communication passage 53 as the communication path. The communication passage 53 is formed in the cylinder block 1 so as to extend through the cylinder block 1. The other structure of the compressor is the same as the compressor in the first preferred embodiment. In the compressor, the same advantageous effects are obtained as mentioned in the first preferred embodiment In a compressor of the fifth preferred embodiment, the same communication grooves 50 as in the first preferred embodiment are formed in the three cylinder bores 1*a* that are located in an upper side of the compressor that is above a horizontal line L in a state when the compressor is installed in a vehicle. The other structure of the compressor is the same as the compressor in the first preferred embodiment.

In the compressor, the lubricating oil is easily supplied to the three cylinder bores 1*a* in which the lubricating oil tends to be lacking due to its own weight. The sliding performance in the corresponding compression chambers 30 is ensured by the lubricating oil supplied through the communication grooves 50. The other advantageous effects are the same as mentioned in the first preferred embodiment. The amount of the lubricating oil in the crank chamber 8 can be adjusted by changing the location and the number of the communication groove 50. Furthermore, in this embodiment, the communication groove 50 of the first preferred embodiment can be changed to the communication groove 51, the communication groove 52, or the communication passage 53.

Figure 10:
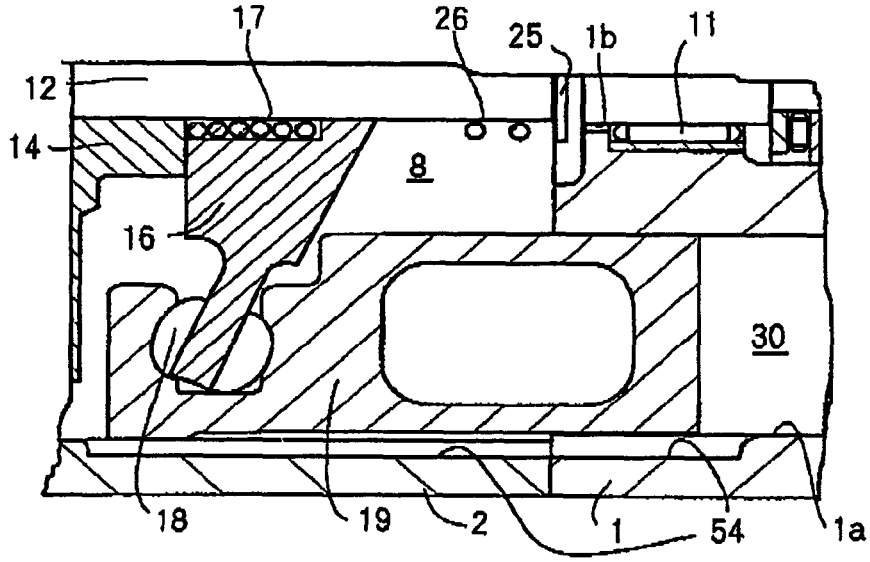
FIG. 10 is a partially enlarged longitudinal cross-sectional view of a compressor according to a sixth preferred embodiment.
Figure 11:
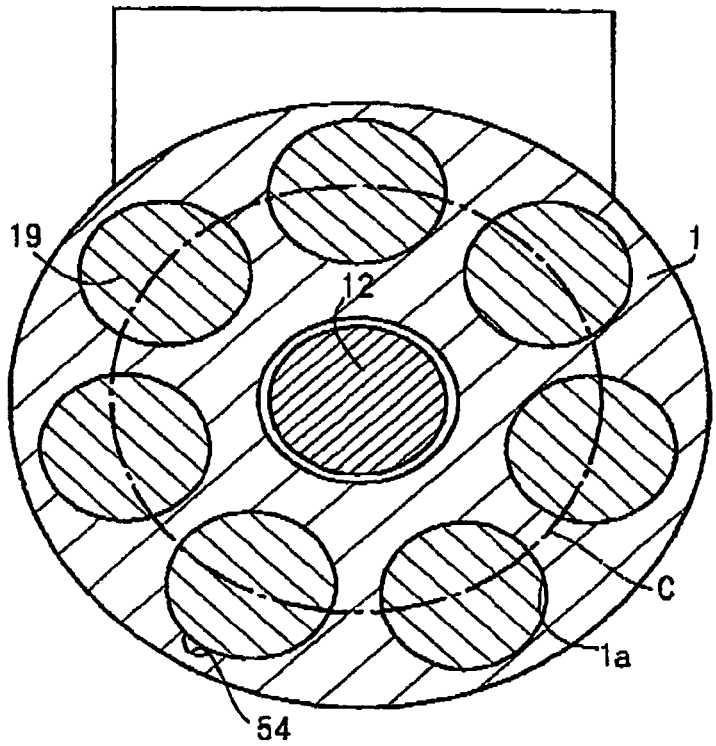
FIG. 11 is a cross-sectional view of the compressor according to the sixth preferred embodiment

In a compressor of the sixth preferred embodiment, as shown in FIG. 10, the communication groove 50 of the first preferred embodiment is changed to a communication groove 54 as the communication path. The communication groove 54 is formed in the front housing 2 and the cylinder block 1. As shown in FIG. 11, the communication groove 54 is located in the outer circumferential area that is far from the drive shaft 12 and that is outside the circle C which passes through the center axis of each of the cylinder bores 1*a*. The other structure of the compressor is the same as the compressor in the first preferred embodiment In the compressor, a large amount of the lubricating oil in the crank chamber 8 can be reduced by the centrifugal force generated by the rotation of the swash plate 16. The other advantageous effects are the same effects as mentioned in the first preferred embodiment.

Figure 12:
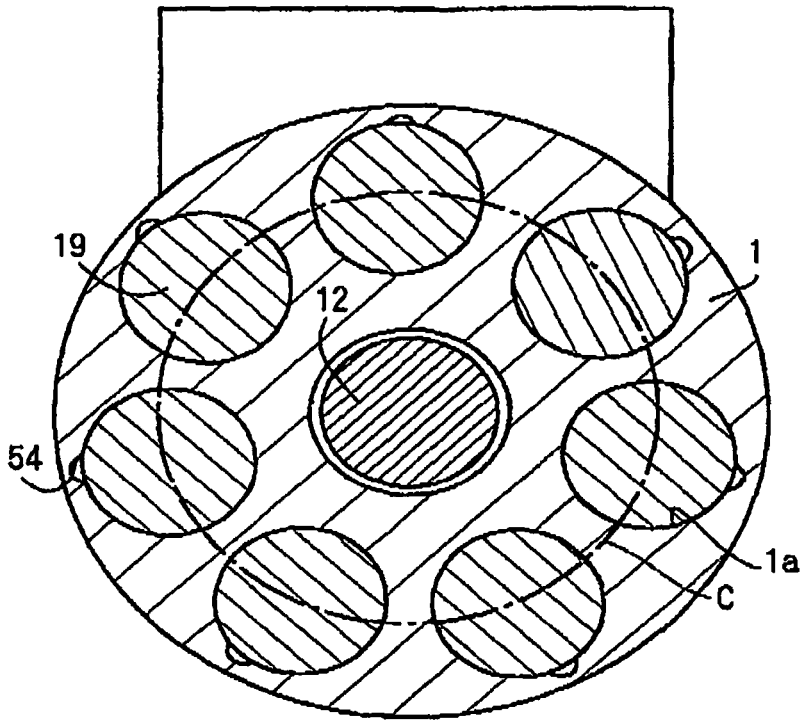
FIG. 12 is a cross-sectional view of a compressor according to a seventh preferred embodiment.

In a compressor of the seventh preferred embodiment, as shown in FIG. 12, communication grooves 54 are formed in all of the bores surfaces of the cylinder block 1. The other structure of the compressor is the same as the compressor in the first preferred embodiment. In the compressor, the lubricating oil can be supplied to all cylinder bores 1*a* through the communication grooves 54.

Figure 13:
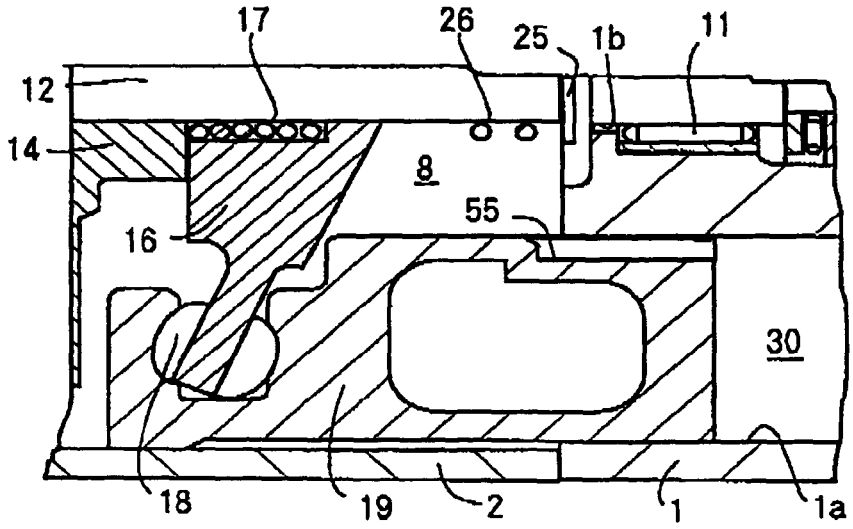
FIG. 13 is a partially enlarged longitudinal cross-sectional view of a compressor according to an eighth preferred embodiment.
Figure 14A:
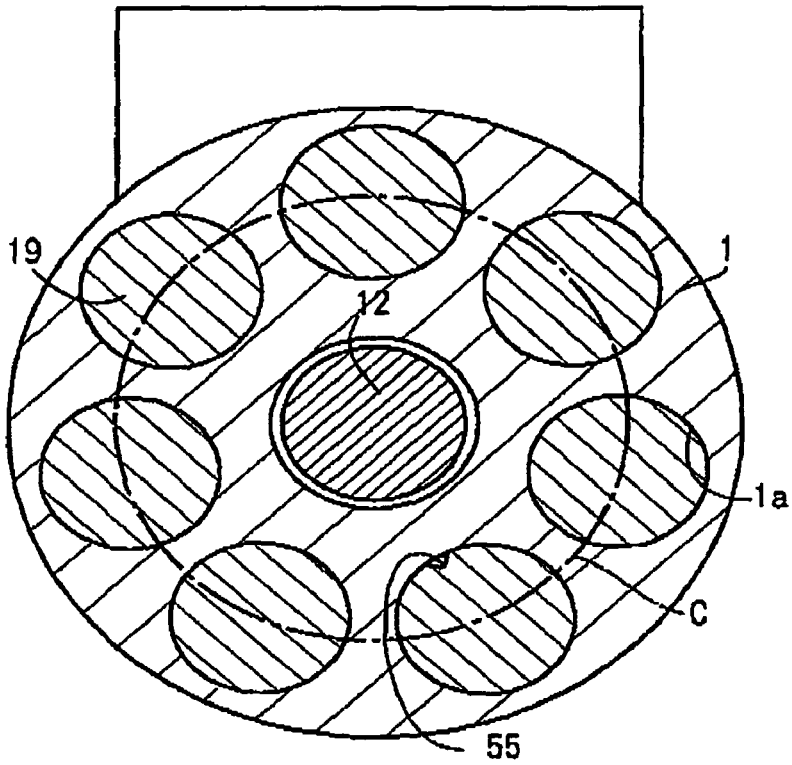
FIG. 14A is a cross-sectional view of the compressor according to the eighth preferred embodiment.
Figure 14B:
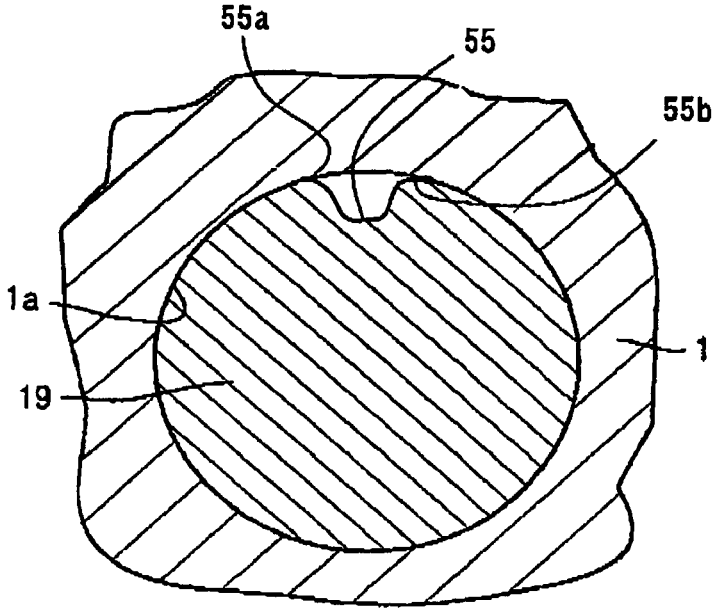
FIG. 14B is a partially enlarged view of FIG. 14A.
Figure 14C:
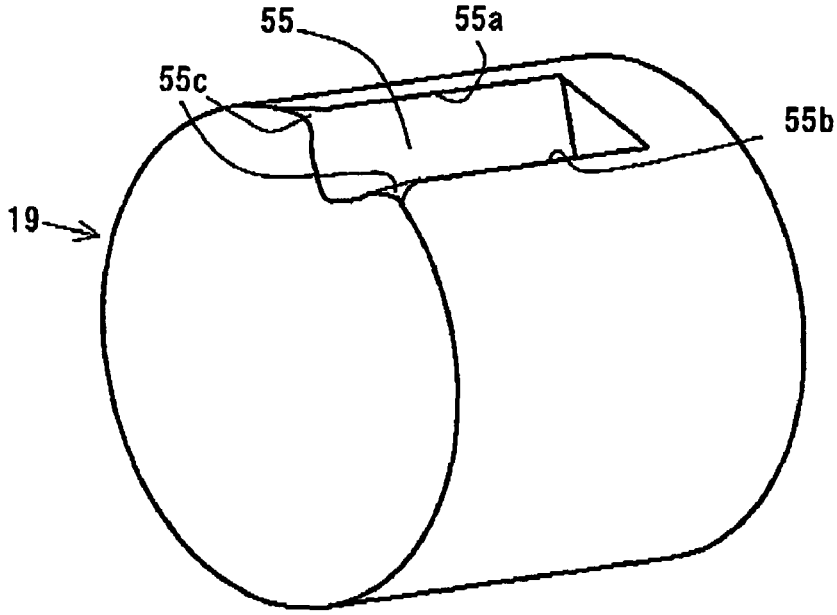
FIG. 14C is a perspective view of the head of a piston according to the eighth preferred embodiment.

In a compressor of the eighth preferred embodiment, as shown in FIGS. 13 through 14C, the communication groove 50 of the first preferred embodiment is changed to a communication groove 55 as the communication path. The communication groove 55 is formed in the outer circumferential surface and the end surface of the piston 19 at the head side of the piston 19. The communication groove 55 axially extends to the compression chamber 30. As shown in FIGS. 14B and 14C, Chamfers 55*a* and 55*b* are formed respectively at both side surfaces of the communication groove 55. As shown in FIG. 14C, chamfers 55*c* are formed at the periphery of the communication groove 55 at the compression chamber side. The other structure of the compressor is the same as the compressor in the first preferred embodiment. In the compressor, the same advantageous effects are obtained as mentioned in the first preferred embodiment.

Figure 15:
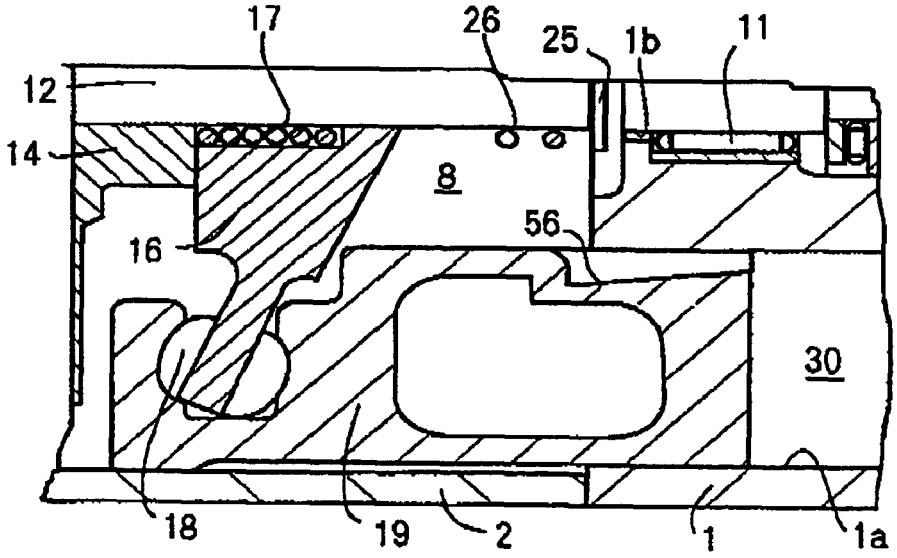
FIG. 15 is a partially enlarged longitudinal cross-sectional view of a compressor according to a ninth preferred embodiment.

In a compressor of the ninth preferred embodiment, as shown in FIG. 15, the communication groove 50 of the first preferred embodiment is changed to a communication groove 56 as the communication path. The communication groove 56 formed in the outer circumferential surface of the piston 19 is deeper at the crank chamber side than at the compression chamber side so as to have a trapezoidal longitudinal section. Therefore, the cross-sectional area of the communication groove 56 at the crank chamber side is larger than that at the compression chamber side. Namely, the cross-sectional area of the end of the communication groove 56 at the crank chamber side is larger than any other cross-sectional area of the communication groove 56. The other structure of the compressor is the same as the compressor in the first preferred embodiment.

In the compressor, the lubricating oil in the crank chamber 8 is easily introduced into the communication groove 56 in the maximum displacement operation of the compressor. Therefore, the advantageous effects of the present invention can be enhanced.

Figure 16:
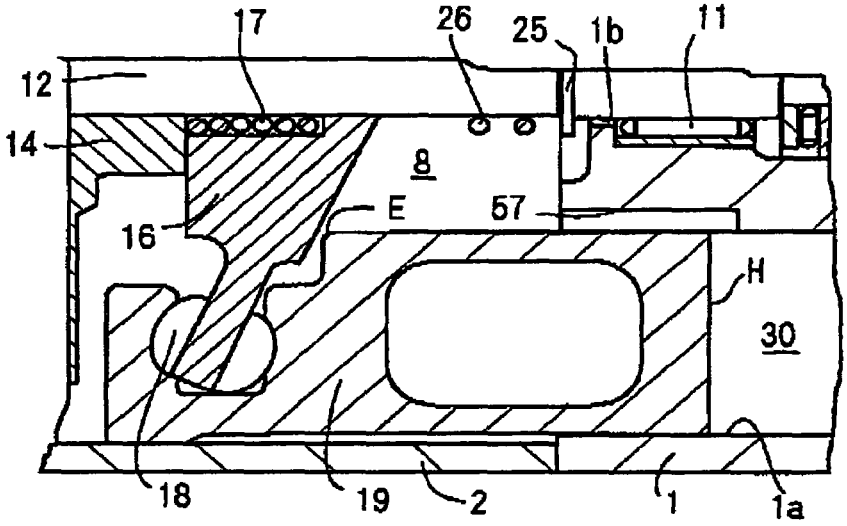
FIG. 16 is a partially enlarged longitudinal cross-sectional view of a compressor according to a tenth preferred embodiment.
Figure 17:
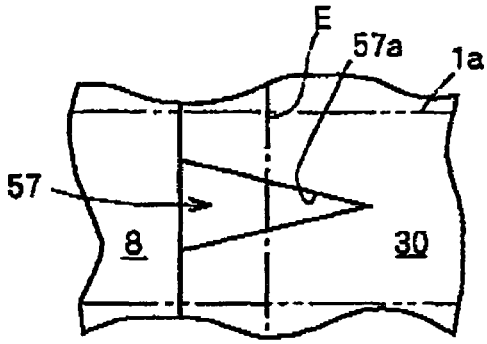
FIG. 17 is a partially enlarged plan view of the compressor when viewed from the inside of a cylinder bore according to the tenth preferred embodiment.

In a compressor of the tenth preferred embodiment, as shown in FIG. 16, the communication groove 50 of the first preferred embodiment is changed to a communication groove 57 as the communication path. The communication groove 57 is formed in the bore surface of the cylinder block 1 at the near side of the axis of the drive shaft. The communication groove 57 is constituted of an introduction portion 57*a* for introducing the lubricating oil to the compression chamber 30. The introduction portion 57*a* is broader at the crank chamber side than at the compression chamber side and that forms substantially a sector in shape when viewed from the inside of the cylinder bore 1*a* as shown in FIG. 17. A periphery E of the piston 19 at the swash plate side is positioned at the introduction portion 57*a* when the piston 19 is located substantially at its top dead center.

In the compressor, the same advantageous effects are obtained as mentioned in the first preferred embodiment. If the communication groove 57, which is formed in the bore surface of the cylinder block 1, extends axially so as to have sides parallel to each other and does not form a sector in shape when viewed from the inside of the cylinder bore 1*a*, the periphery E of the piston 19 slides over the communication groove 57 at its one position in a circumferential direction of the piston 19. In this case, the sliding film may abrade. However, the introduction portion 57*a* is broader at the crank chamber side than at the compression chamber side and forms substantially a sector in shape when viewed from the inside of the cylinder bore 1*a*. Therefore, the periphery E of the piston 19 at the swash plate side slides over the introduction portion 57*a* of the communication groove 57 at its different position in the circumferential direction of the piston 19. As a result, the abrasion of the piston 19, especially the abrasion of the sliding film can be avoided.

Figure 18:
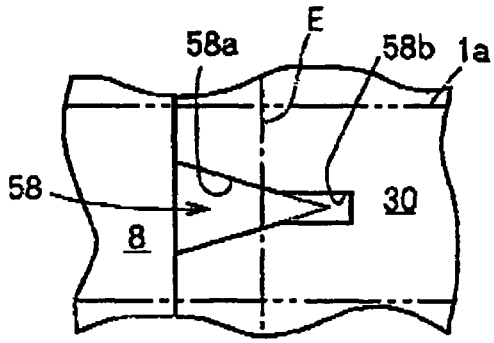
FIG. 18 is a partially enlarged plan view of a compressor when viewed from the inside of a cylinder bore according to a eleventh preferred embodiment.
Figure 19:
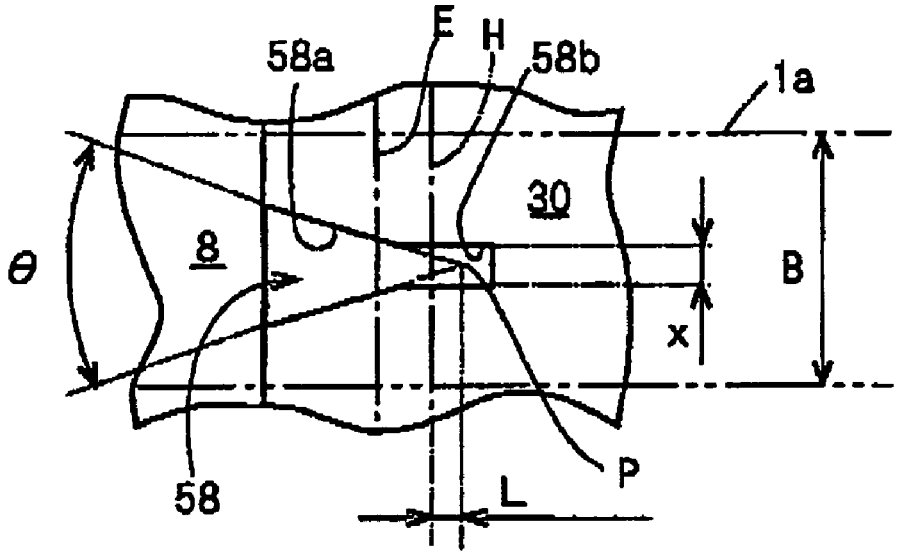
FIG. 19 is an explanatory view of FIG. 18.
Figure 20:
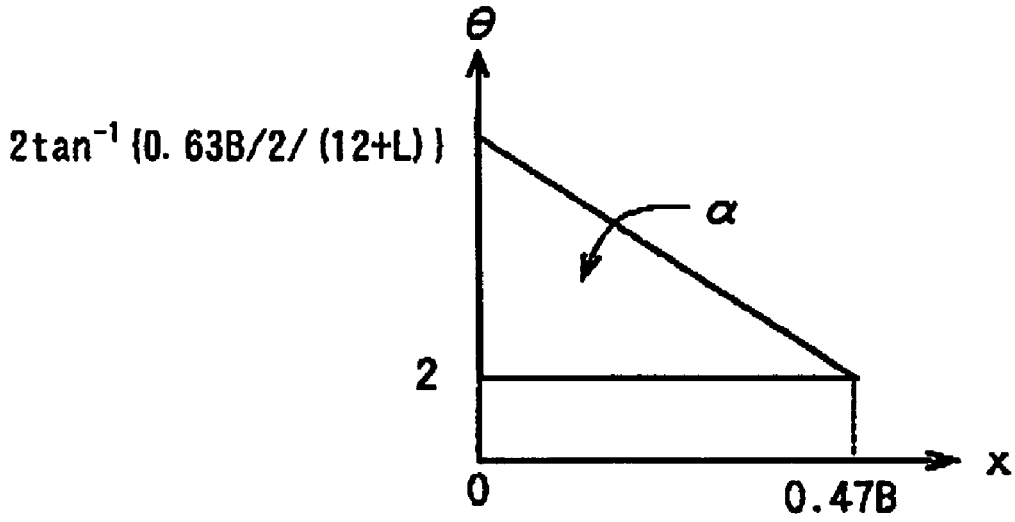
FIG. 20 is a graph showing a relationship between the width of a straight flute portion and the central angle of an introduction portion according to the eleventh preferred embodiment.

In a compressor of the eleventh preferred embodiment, as shown in FIG. 18, the communication groove 57 is changed to a communication groove 58 as the communication path. The communication groove 58 Includes an introduction portion 58*a* that is the same as the introduction portion 57*a* of the tenth preferred embodiment and a straight flute portion 58*b*. In addition, the straight flute portion 58*b* is formed at the compression chamber side of the introduction portion 58*a* and extends in the axial direction of the drive shaft 12. As shown in FIG. 19, it is assumed that B denotes the diameter of the cylinder bore 1*a* and L denotes the distance between a hypothetical peak P of the introduction portion 58*a* and a rear end surface H of the piston 19 in a state that the inclination angle of the swash plate 16 is substantially the maximum inclination angle and that the piston 19 is located at its bottom dead center. Particularly, in this case, a width X of the straight flute portion 58*b* and a central angle θ of the introduction portion 58*a* ranges in an area a as shown in FIG. 20. Namely, the width X ranges from 0 to 0.47B, and the central angle θ ranges from 2 to 2 $\tan^{-1}\{0.63B/2/(12+L)\}$. The other structure of the compressor is the same as the compressor in the tenth preferred embodiment.

In the compressor, the same advantageous effects are obtained as mentioned in the first preferred embodiment. Especially, in the compressor, the amount of the lubricant oil that is discharged from the crank chamber 8 to the compression chamber 30 through introduction portion 58*a* can be controlled by adjusting the largeness of the straight flute portion 58*b*.

Figure 21:
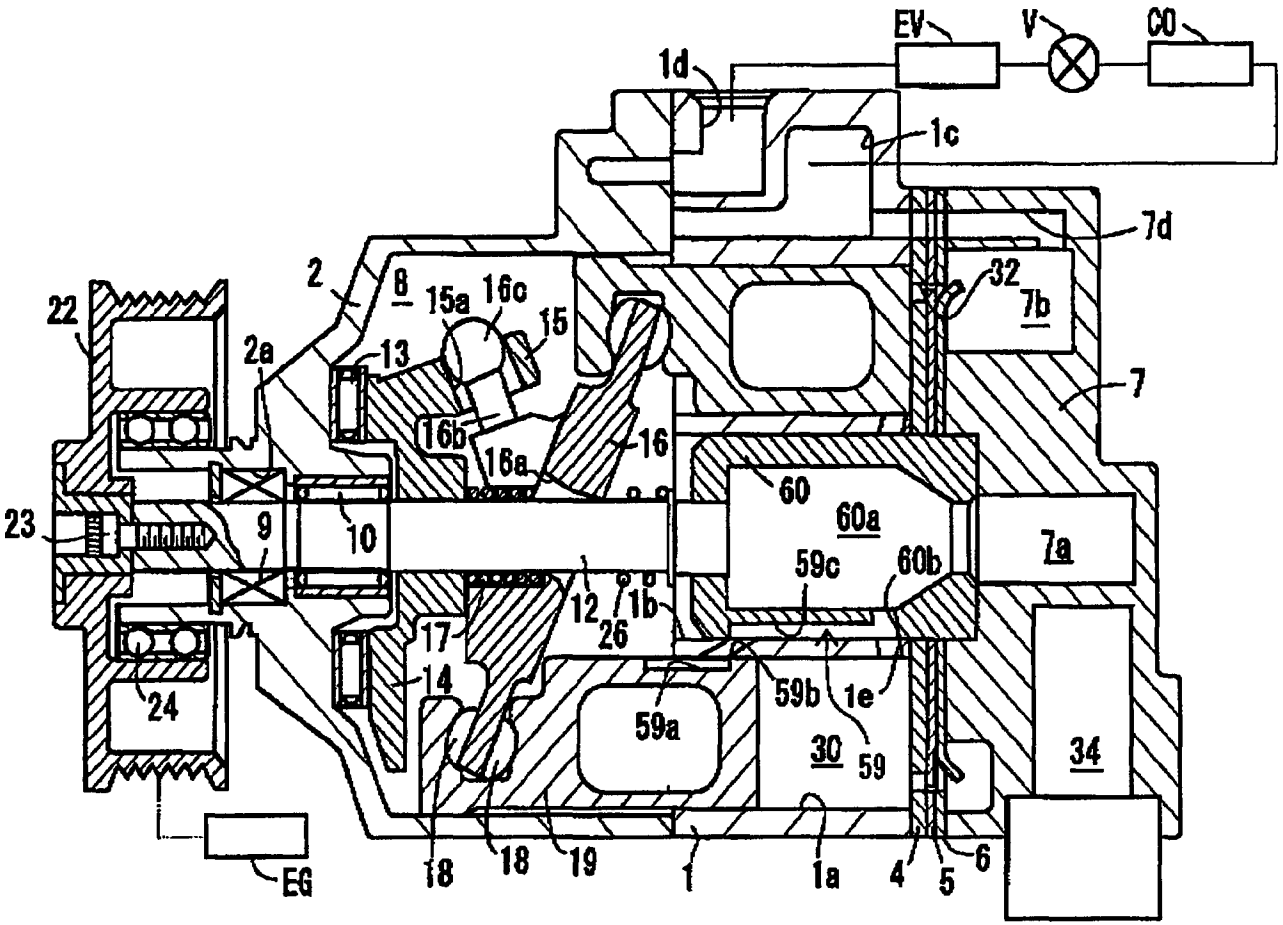
FIG. 21 is a longitudinal cross-sectional view of a compressor according to a twelfth preferred embodiment

In a compressor of the twelfth preferred embodiment, as shown In FIG. 21, a suction chamber 7*a* is formed in an inner area in the rear housing 7 near the middle of the rear housing 7. A discharge chamber 7*b* is formed in an outer area in the rear housing 7 near the outer circumferential surface of the rear housing 7 separately from the suction chamber 7*a*. A rotary valve 60 is located in the shaft hole 1*b* of the cylinder block 1 and is fixed to the rear end of the drive shaft 12. An introduction hole 1*e* is radially formed from the shaft hole 1*b* to each of the compression chambers 30. An introduction chamber 60*a* is formed in the rotary valve 60 and communicates with the suction chamber 7*a*. A suction passage 60*b* is radially formed in the rotary valve 60 and interconnects the introduction chamber 60*a* with the introduction hole 1*e* that communicates with the compression chamber 30 in the suction process.

Also, a first communication groove 59*a* is formed in the outer circumferential surface of the piston 19 so as to extend axially. The first communication groove 59*a* at the crank chamber side is open to the crank chamber 8 only while the inclination angle of the swash plate 16 is substantially the maximum inclination angle and the piston 19 is located substantially at its bottom dead center. A communication passage 59*b* is formed in the cylinder block 1 so as to extend through the cylinder block 1. The communication passage 59*b* interconnects the first communication groove 59*a* at the compression chamber side with the shaft hole 1*b* only while the inclination angle of the swash plate 16 is substantially the maximum inclination angle and the piston 19 is located substantially at its bottom dead center. A second communication groove 59*c* is formed on an outer circumferential surface of the rotary valve 60. The second communication groove 59*c* axially extends and communicates with the suction passage 60*b*. The second communication groove 59*c* communicates with the communication passage 59*b* only while the inclination angle of the swash plate 16 is substantially the maximum inclination angle and the piston 19 is located substantially at its bottom dead center. The first communication groove 59*a*, the communication passage 59*b*, the second communication groove 59*c*, the suction passage 60*b* and the introduction hole 1*e* are included in a communication path 59 that interconnects the crank chamber 8 with the compression chamber 30. The other structure is the same as the first preferred embodiment.

In the compressor, the rotary valve 60 is rotated integrally with the drive shaft 12 and interconnects the suction chamber 7*a* with the compression chamber 30 in the suction process sequentially, through the introduction chamber 60*a*, the suction passage 60*b* and the introduction hole 1*e*. Therefore, the suction valve plate 3 as shown in FIG. 1 is can be removed from the compressor, and the decrease in compression efficiency which is caused by resistance to suction at the suction valve 3*a* can be avoided.

Also, the second communication groove 59*c*, which is formed on the outer circumferential surface of the rotary valve 60, interconnects the communication passage 59*b* and the first communication groove 59*a* with the suction passage 60*b* only while the inclination angle of the swash plate 16 is substantially the maximum inclination angle and the piston 19 is located substantially at its bottom dead center. Therefore, the crank chamber 8 is interconnected with the compression chamber 30 through the first communication groove 59*a*, the communication passage 59*b*, the second communication groove 59*c*, the suction passage 60*b* and the introduction hole 1*e* as the communication path 59. Accordingly, in the compressor, the same advantageous effects are obtained as mentioned in the first preferred embodiment. Furthermore, in the twelfth preferred embodiment, in which the rotary valve 60 is utilized, the timing when the refrigerant is drawn into the cylinder bore 1*a* can be changed by adjusting the largeness and the location of the suction passage 60*b* of the rotary valve 60. Therefore, the amount of the lubricant oil that discharged from the crank chamber 8 into the cylinder bore 1*a* can be easily adjusted.

According to the present invention, the following alternative preferred embodiments may be practiced.

Figure 2B:
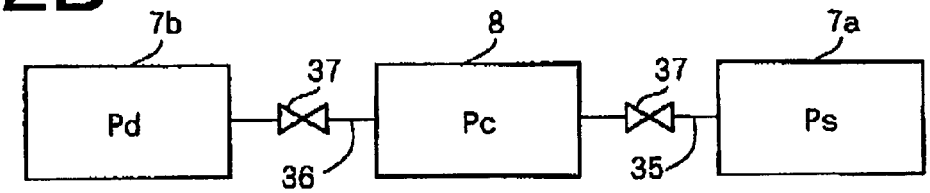
FIG. 2B is a view illustrating a three-way valve control mechanism according to a first alternative preferred embodiment.

The supply control mechanism is utilized as the control mechanism as shown in FIG. 2A in the above-mentioned first preferred embodiment. However, in a first alternative preferred embodiment, a three-way valve control mechanism may be utilized as the control mechanism as shown in FIG. 2B. In the three-way valve control mechanism, a control valve 37 is arranged on the supply passage 36 that interconnects the discharge chamber 7*b* to the crank chamber 8, and on the bleed passage 35 that interconnects the crank chamber 8 to the suction chamber 7*a*. The control valve 37 adjusts both opening degrees of the supply passage 36 and the bleed passage 35 in accordance with the suction pressure Ps in the suction chamber 7*a*. The three-way valve control mechanism is constituted of the supply passage 36, the control valve 37, the bleed passage 35 and the clearance between the piston 19 and the cylinder bore 1*a*. In the compressor, although a control mechanism is the three-way valve control mechanism, the same advantageous effects are obtained by the communication groove 50 as mentioned in the above-mentioned first preferred embodiment.

The pulley 22 is provided directly to the drive shaft 12 of the compressor in the above-mentioned first preferred embodiment. In a second alternative preferred embodiment, the pulley 22 is not provided directly to the drive shaft 12 of the compressor, and an electromagnetic clutch may be provided to the drive shaft 12.

The communication groove 57 or 58 is formed in one of the cylinder bores 1*a* in the above-mentioned tenth or eleventh preferred embodiment. In a third alternative preferred embodiment, the communication grooves 67 or 58 may be formed in all cylinder bores 1*a*. The communication grooves 57 or 58 may be formed in any position of the cylinder bores 1*a* in a circumferential direction of the cylinder bores 1*a*. Since the side force is applied to the piston 19, it is preferable that the communication grooves 57 are formed in the bore surface of the cylinder block 1 at the near side of the axis of the drive shaft 12.

The second communication groove 59*c* that is a part of the communication path is formed on the outer circumferential surface of the rotary valve 60 in the above-mentioned twelfth preferred embodiment. However, in a fourth alternative preferred embodiment, the communication path may not be formed in the rotary valve 60 and may be formed in one of the cylinder bore 1*a*, the piston 19, the cylinder block 1 and the front housing 2, or in a combination selected from the cylinder bore 1*a*, the piston 19, the cylinder block 1 and the front housing 2, similarly to the above-mentioned preferred embodiments except for the above-mentioned twelfth preferred embodiment. In the above structure, the same advantageous effects are obtained as mentioned in the above-mentioned first preferred embodiment.

In the above-mentioned preferred embodiments, the lubricating oil stored in the crank chamber 8 is discharged into the compression chamber 30 while the inclination angle of the swash plate 16 is substantially the maximum inclination angle. However, in a fifth alternative preferred embodiment, the lubricating oil stored in the crank chamber 8 may be discharged into the suction chamber 7*a* or the discharge chamber 7*b* while the inclination angle of the swash plate 16 is substantially the maximum inclination angle in the above-mentioned preferred embodiments. Or, the lubricating off stored in the crank chamber 8 may be discharged into any combination selected from the suction chamber 7*a*, the discharge chamber 7*b* and the compression chamber 30 while the inclination angle of the swash plate 16 is substantially the maximum inclination angle in the above-mentioned preferred embodiments.

The present examples and embodiments are to be considered as illustrative and not restrictive, and the invention is not to be limited to the details given herein but may be modified within the scope of the appended claims.

What is claimed is:

1. A swash plate type variable displacement compressor connected to an external drive source for compressing refrigerant gas that contains lubricating oil comprising:

a cylinder block defining a cylinder bore;

a housing fixed to the cylinder block, the housing defining a crank chamber, a suction chamber and a discharge chamber;

a drive shaft supported by the housing and the cylinder block for rotation, the drive shaft being driven by the external drive source, the drive shaft having an axis;

a swash plate supported by the drive shaft in the crank chamber so as to rotate integrally with the drive shaft, the swash plate being inclinable with respect to the axis of the drive shaft, an inclination angle of the swash plate being varied in accordance with the pressure in the crank chamber;

a piston accommodated in the cylinder bore so as to define a compression chamber in the cylinder bore, the piston being coupled to the swash plate, the rotation of the swash plate being converted into the reciprocating movement of the piston, displacement of the compressor being varied by the reciprocation of the piston in accordance with the inclination angle of the swash plate;

a control mechanism for controlling pressure in the crank chamber, the control mechanism including a bleed passage that interconnects the crank chamber with the suction chamber for decreasing the pressure in the crank chamber; and a communication path for interconnecting the crank chamber with the compression chamber only while the inclination angle of the swash plate is substantially the maximum inclination angle and the piston is located substantially at its bottom dead center.

2. The compressor according to claim 1, wherein the control mechanism includes:

a supply passage interconnecting the discharge chamber with the crank chamber; and a control valve arranged on the supply passage for adjusting an opening degree of the supply passage, wherein the bleed passage has a constant inner diameter for continuously interconnecting the crank chamber with the suction chamber regardless the inclination angle of the swash plate.

3. The compressor according to claim 1, wherein the compressor is continuously driven while the external drive source is running.

4. The compressor according to claim 1, wherein the communication path is a communication groove that is formed in the cylinder bore.

5. The compressor according to claim 4, wherein the communication groove includes an introduction portion for introducing the lubricating oil to the compression chamber, the introduction portion being broader at a crank chamber side than at a compression chamber side and forming substantially a sector in shape when viewed from the inside of the cylinder bore, a periphery of the piston at a swash plate side being positioned at the introduction portion when the piston is located substantially at its top dead center.

6. The compressor according to claim 5, wherein the communication groove includes a straight flute portion that is formed at the compression chamber side of the introduction portion and that extends in an axial direction of the drive shaft.

7. The compressor according to claim 6, wherein a width of the straight flute portion ranges from 0 to 0.47 B, a central angle of the introduction portion ranging from 2 to 2 $\tan^{-1}\{0.63B/2/(12+L)\}$, B denoting the diameter of the cylinder bore, L denoting the distance between a hypothetical peak of the introduction portion and a rear end surface of the piston in a state that the inclination angle of the swash plate is the maximum inclination angle and that the piston is located at its bottom dead center.

8. The compressor according to claim 5, wherein the communication groove is formed at the inner side of the bore surface of the cylinder block.

9. The compressor according to claim 4, wherein chamfers are formed respectively at both side surfaces of the communication groove.

10. The compressor according to claim 4, wherein a chamfer is formed at a periphery of the communication groove at a compression chamber side.

11. The compressor according to claim 1, wherein the communication path is a communication groove that is formed in an outer circumferential surface of the piston.

12. The compressor according to claim 11, wherein chamfers are formed respectively at both side surfaces of the communication groove.

13. The compressor according to claim 11, wherein a chamfer is formed at a periphery of the communication groove at a compression chamber side.

14. The compressor according to claim 1, wherein the communication path is a communication passage that extends through the cylinder block.

15. The compressor according to claim 14, wherein a chamfer is formed at an opening of the communication passage at a compression chamber side.

16. The compressor according to claim 1, wherein the communication path is in communication with the compression chamber that is located in an upper side of the compressor in a state when the compressor is installed in a vehicle.

17. The compressor according to claim 1, wherein an end of the communication path at a crank chamber side is located in an inner circumferential area near the drive shaft.

18. The compressor according to claim 1, wherein an end of the communication path at a crank chamber side is located in an outer circumferential area far from the drive shaft.

19. The compressor according to claim 18, wherein the communication path is a communication groove that is formed in the housing and the cylinder block.

20. The compressor according to claim 19, wherein the cylinder block has a plularity of bore surfaces that define the cylinder bores, the communication groove being formed in each of the bore surfaces.

21. The compressor according to claim 1, wherein a cross-sectional area of an end of the communication path at a crank chamber side is larger than any other cross-sectional area of the communication path.

22. The compressor according to claim 1, wherein the cylinder block has a shaft hole, the housing including a rear housing that is located at a rear end side of the drive shaft, the rear housing forming the suction chamber in an inner area in the rear housing and the discharge chamber in an outer area in the rear housing separately from the suction chamber, the compressor including a rotary valve that is placed at a rear end of the drive shaft, the rotary valve being located in the shaft hole of the cylinder block and interconnecting the suction chamber with the compression chamber when the compression chamber is in a suction process, the communication path including a communication groove that is formed on an outer circumferential surface of the rotary valve.

23. The compressor according to claim 1, wherein the control mechanism includes:

a supply passage interconnecting the discharge chamber with the crank chamber, and a control valve arranged on the supply passage and the bleed passage, the control valve adjusting both opening degrees of the supply passage and the bleed passage.

24. The compressor according to claim 1, wherein the communication passage directly interconnects the crank chamber with the compression chamber.

* * * * *